US005921811A

United States Patent [19]

Hsu

[11] Patent Number: 5,921,811

[45] Date of Patent: Jul. 13, 1999

[54] CONNECTOR AND ASSOCIATED BOARDLOCK

[75] Inventor: Sung Liu Hsu, Taipei Hsien, Taiwan

[73] Assignee: Hon Hai Precision Ind. Co., Ltd., Taipei Hsien, Taiwan

[21] Appl. No.: 08/835,863

[22] Filed: Apr. 8, 1997

[51] Int. Cl.[6] ..... H01R 13/73

[52] U.S. Cl. ..... 439/567; 439/607

[58] Field of Search ..... 439/567, 607, 439/571, 572

[56] References Cited

U.S. PATENT DOCUMENTS

| | | | |
|---|---|---|---|
| 4,582,384 | 4/1986 | Frantz et al. | 439/610 |
| 4,943,244 | 7/1990 | Teck et al. | 439/567 |
| 5,024,607 | 6/1991 | Kachlic | 439/567 |
| 5,066,237 | 11/1991 | Shiley | 439/567 |
| 5,163,851 | 11/1992 | Hart et al. | 439/567 |
| 5,356,313 | 10/1994 | Niwa et al. | 439/567 |
| 5,423,696 | 6/1995 | Sato | 439/567 |
| 5,599,207 | 2/1997 | Lai | 439/567 |

*Primary Examiner*—Gary Paumen

[57] ABSTRACT

An electrical connector includes an insulative housing (10) comprising a support frame and a mating body wherein the front side of the supporting frame (11) and an end of the mating body commonly form a mating face (14). A plurality of contacts (20) are disposed in the mating body wherein one end (22) of the contact (20) is connected to the PC board on which the connector is mounted. A shield (30) is attached to the mating face (14) for preventing electromagnetic interference. A boardlock (40) includes a supporting portion (41) and a leg portion (43) wherein the leg portion (43) is mounted to the PC board and the supporting portion (41) is disposed in the housing (10) whereby the supporting portion (41) can be electrically interconnected with the shield (30).

8 Claims, 4 Drawing Sheets

CONNECTOR AND ASSOCIATED BOARDLOCK

BACKGROUND OF THE INVENTION

1. Field of the Invention

The invention relates to electrical connector for use with a computer, and particularly to the connector having the boardlock adapted to be easily assembled to the housing thereof.

2. The Related Art

As shown in FIG. 1, the conventional connector includes an insulative housing 10', a plurality of contacts 20', a shield 30' and a boardlock 40' wherein the housing 10' includes a mating body 11' and a mating face 14'. The contacts 20' extend into the mating body 14'. The shield 30' covers the mating face 14' for preventing electromagnetic interference. The boardlock 40' includes a tag portion 42', a supporting portion 41' and a leg portion 43' wherein the leg portion 43' extends through the PC board (not shown). The boardlock 40' is fastened to the housing 10' by means that a protrusion section 51' of a screw nut 50' extends through an opening 44' in the tag portion 42' of the boardlock 40', the opening 13' in the housing 10' and the opening 31' of the shield 30', and that the distal end of the protrusion section 51' is backward folded to fasten the boardlock 40', the housing 10' and the shield 30' together. Thus, the shield 30' can be grounded, through the boardlock 40', to the PC board.

The aforementioned assembling method of the boardlock 40' to the housing 10', is complicate and requires too many components, thus increasing manufacturing difficulties, assembling time and the corresponding cost thereof. Additionally, it is not easy to handle or ship too many different type components or assort them in the inventory.

Therefore, an object of the invention is to provide an electrical connector having the boardlock thereon wherein such boardlock is easy to be assembled to the housing and is adapted to provide a grounding path for the shield thereof.

SUMMARY OF THE INVENTION

According to an aspect of the invention, an electrical connector includes an insulative housing comprising a support frame and a mating body wherein the front side of the supporting frame and an end of the mating body commonly form a mating face. A plurality of contacts are disposed in the mating body wherein one end of the contact is connected to the PC board on which the connector is mounted. A shield is attached to the mating face for preventing interference. A boardlock includes a supporting portion and a leg portion wherein the leg portion is mounted to the PC board and the supporting portion is disposed in the housing, whereby the supporting portion can be electrically interconnected with the shield. Because the shield itself is directly fastened to the housing, and the boardlock is retained in the housing for electrical and mechanical engagement with the shield, thus eliminating the screw nut which is originally used for securement and grounding purposes. Therefore, to the connector, the number of components is reduced for easy management, and assembling time is decreased, thus saving the cost.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
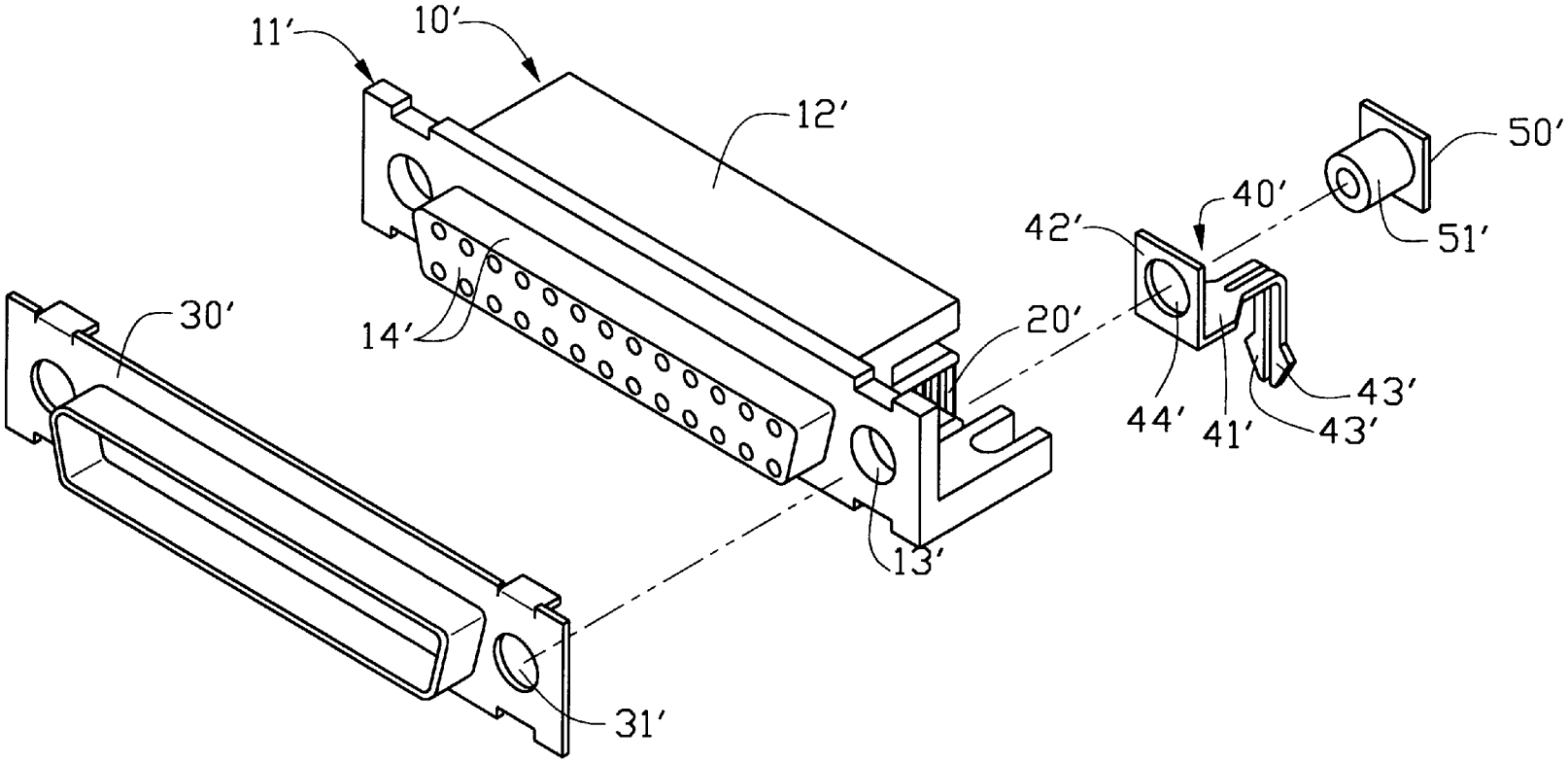
FIG. 1 (PRIOR ART)
FIG. 1 is an exploded perspective view of a conventional connector.
Figure 2:
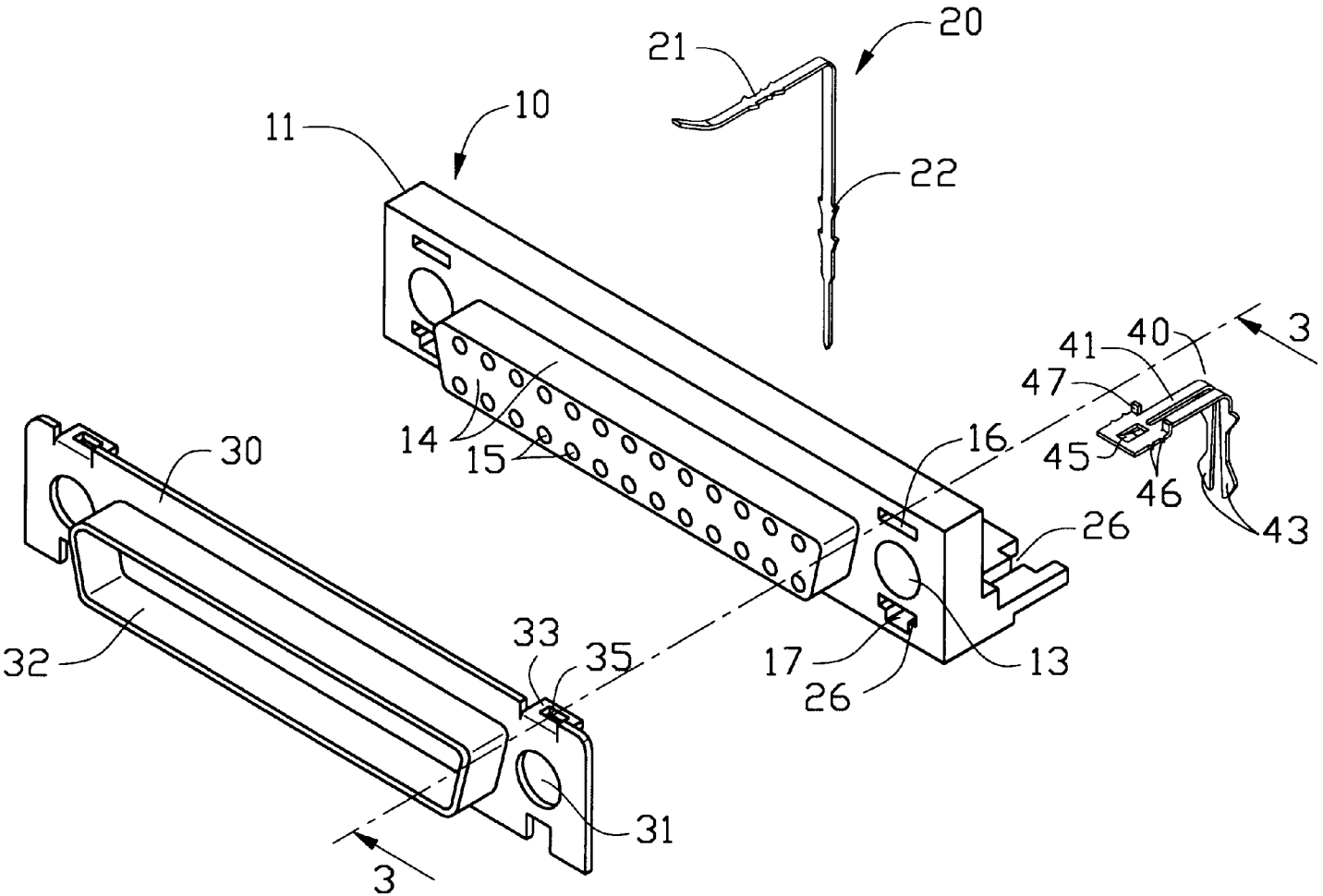
FIG. 2 is an exploded perspective view of a presently preferred embodiment of an electrical connector, according to the invention.
Figure 3:
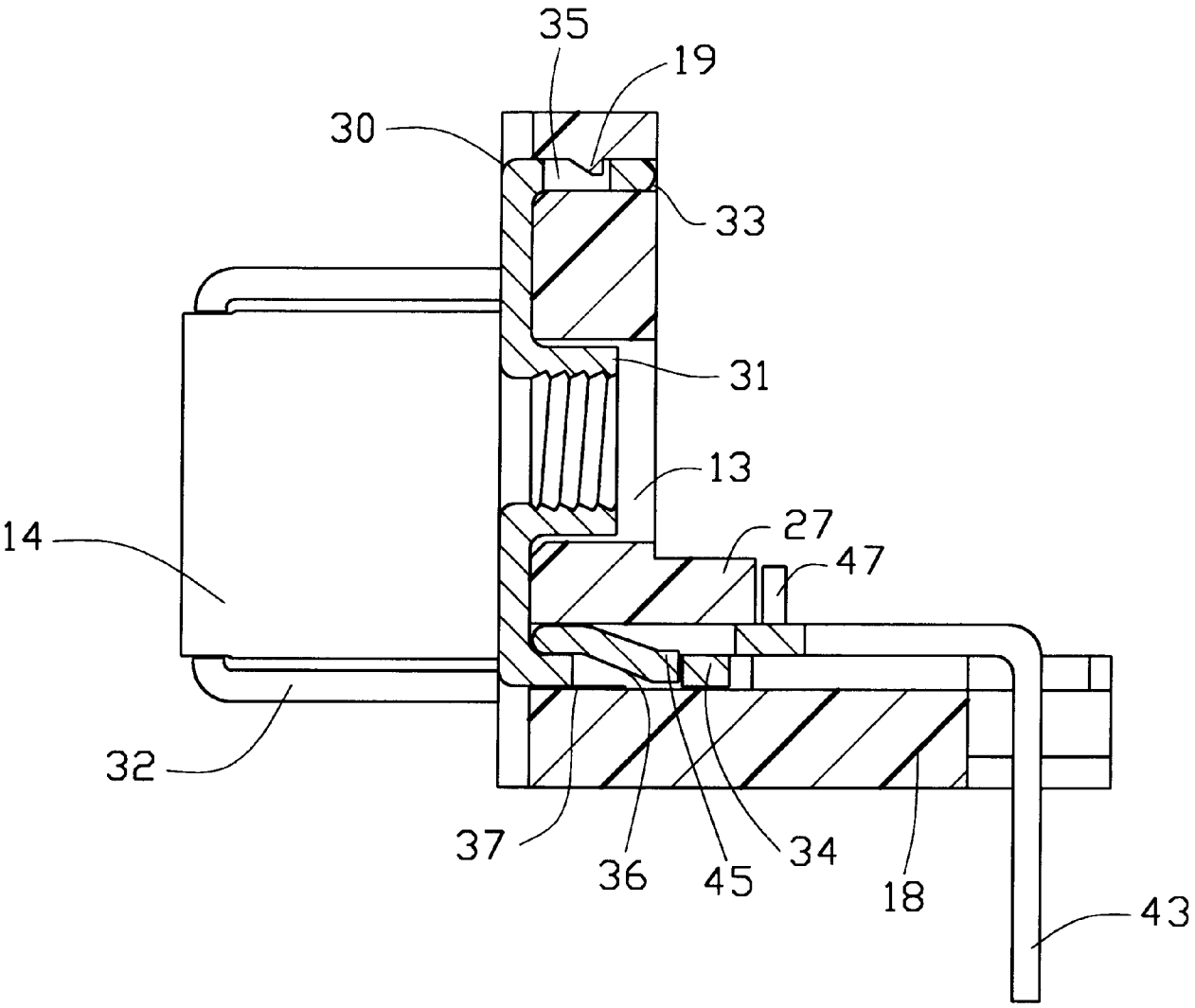
FIG. 3 is a cross-sectional view of the connector of FIG. 2.
Figure 4:
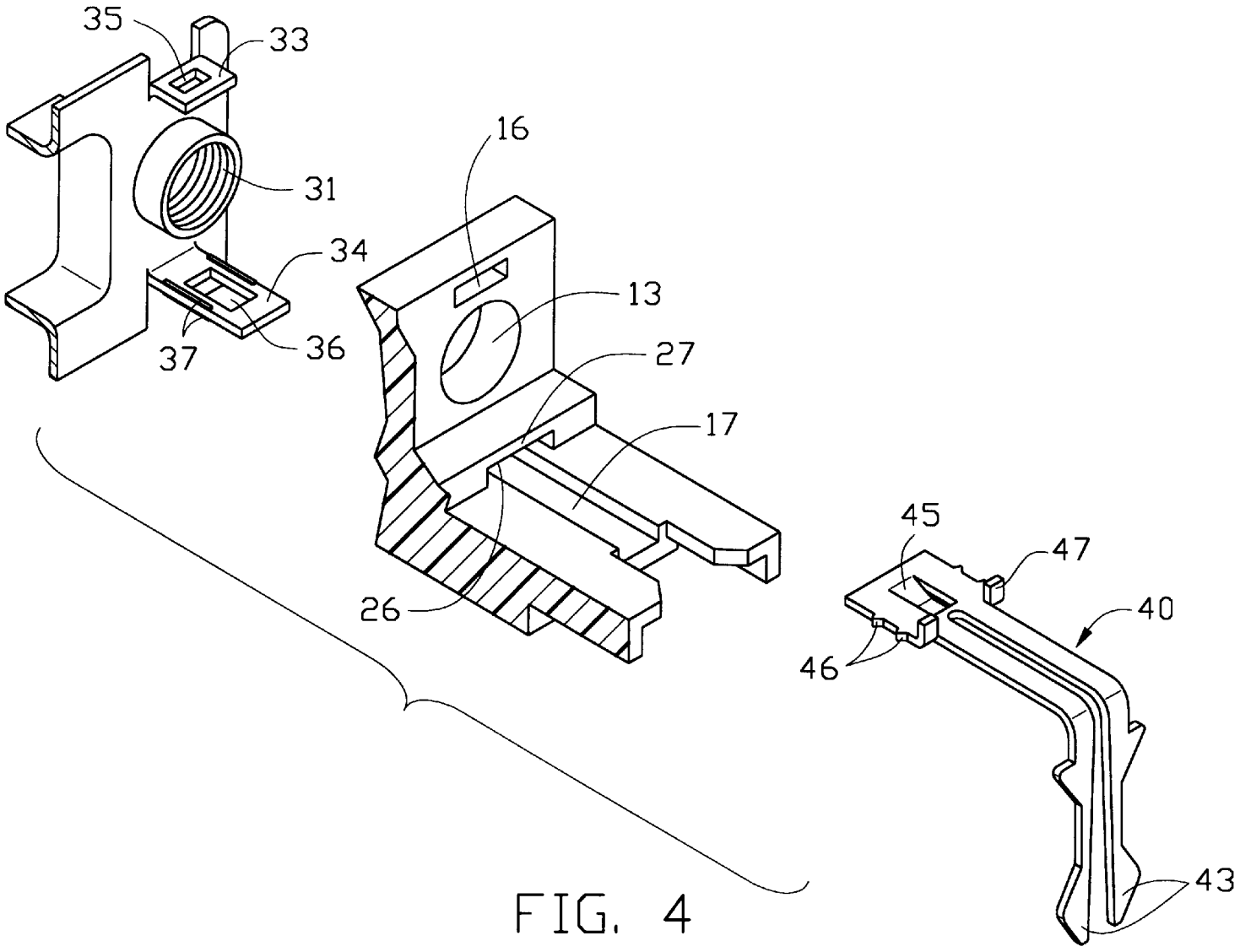
FIG. 4 is an enlarged fragmentary exploded perspective view of the connector of FIG. 2.

It will be noted here that for a better understanding, most of like components are designated by like reference numerals throughout the various figures in the embodiments. Attention is directed to FIGS. 2–4 wherein an electrical connector includes an insulative housing 10, a plurality of contacts 20, a shield 30 and two boardlocks 40 (only one shown). The housing 10 includes a mating face 14 through which a plurality of passageways 15 extend for receiving mating ends 21 of the corresponding number of contacts 20. The tail 22 of each contact 20, opposite to the mating end 21, extends downward from the back of the frame 11 of the housing 10 for connection to the PC board (not shown) on which the connector is mounted. In addition, disposed on two sides of the housing 10 are a pair of openings 13, respectively. An upper slot 16 and a lower slot 17 are respectively positioned adjacent each opening 13 wherein a hook 19 is formed in the upper slot 16.

The shield 30 is attachbly secured to the mating face 14 of the housing 10 for preventing electro-magnetic interference. The shield 30 includes an opening section 32 for receiving the mating face 14 and a pair of threaded holes 31. An upper tag 33 and a lower tag 34 are respectively positioned by two sides of each hole 31 and extend rearward from two opposite edges of the shield 30 wherein each tag 33, 34 includes an opening 35, 36. The lower tag further includes a pair of ribs 37 on its under-surface.

The boardlock 40 includes a supporting portion 41 and a right angle leg portion 43 rearward and downward extending from the rear portion of the supporting portion 41 wherein the supporting portion 41 forms an engagement tang 45. A pair of barbs 46 are disposed on two side edges of the supporting portion 41 and a pair of stopper plates 47 extend upward from the rear edge of the supporting portion 41.

When assembled, the shield 30 and the boardlocks 40 are attached to the housing 10 by means that the tags 33, 34 of the shield 30 are inserted into the corresponding slots 16, 17 of the housing 10 wherein the hook 19 in the upper slot 16 may be latchably engaged within the opening 35 of the upper tag 33, and the ribs 37 of the lower tag 34 substantially interferes with the corresponding surface 18 in the lower slot 17. Then, the boardlock 40 is attached to the housing 10 from the back with the supporting portion 41 being retainably, by means of the barbs 41, inserted into a channel 26, which is communicatively positioned above the lower slot 17. Under this situation, the front portion of the supporting portion 41 of the boardlock 40 abuts against the lower tag 34, the engagement tang 45 extends obliquely downward into the lower slot 17 and is received within the opening 36 of the lower tag 34, and the stopper plates 47 abut the wall 27 on the back portion of the housing 10.

Therefore, the housing 10, the shield 30 and the boardlock 40 can be commonly fastened together.

Because in the invention the shield 30 can be directly and solely fixed to the housing 10 by means of the upper and lower tags 33, 34, and further electrically contacts the boardlock 40 around the lower slot 36, no additional screw nut is required to provide securement and/or grounding performance. In addition, the shield 30 can be omitted if no interference consideration has to be paid attention to. Under this situation, the housing 10 should form an internal step for engagement with the engagement tang 45 instead of the opening 36 of the lower tag 34 to prevent the back movement of the boardlock 40 and retain the boardlock 40 in position with regard to the housing 10. Accordingly, the invention can simplify the components, ease material management, reduce the assembling time, and save cost, thus increasing competition capability.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. An electrical connector, comprising:

an insulative housing including a mating face and having a plurality of contacts therein;

a shield enclosing the mating face;

a boardlock including a supporting portion and a leg portion, the supporting portion lockingly engages with the shield at a site within the housing to retain the boardlock in position.

2. The electrical connector as defined in claim 1, wherein the shield includes a first tag defining a first opening therein, and the supporting portion of the boardlock includes an engagement tang engagingly received within said first opening.

3. The electrical connector as defined in claim 2, wherein at least one rib is formed on the first tag.

4. The electrical connector as defined in claim 2, wherein the shield further includes a second tag defining a second opening for engagement with a hook of the housing whereby the shield can be retained to the housing.

5. The electrical connector as defined in claim 1, wherein the shield has a first tag and a second tag ad the housing includes a first slot and a second slot for receiving the first tag and the second tag of the shield.

6. The electrical connector as defined in claim 5, wherein a channel is formed adjacent to the first slot for receiving the supporting portion of the boardlock therein.

7. The electrical connector as defined in claim 1, wherein the supporting portion further includes at least one stopper plate upward extending therefrom.

8. An electrical connector comprising:

an insulative housing including a plurality of contacts therein and having a mating face and upper and lower slots;

a shield attached to the mating face of the housing;

said shield including at least an upper tag and a lower tag extending rearward from two opposite edges thereof and respectively retainably received within the corresponding upper slot and the corresponding lower slot of the housing; and a boardlock having a supporting portion secured to the housing, and wherein a channel is provided beside and communicative with the lower slot for receiving the supporting portion of the boardlock.

* * * * *